US006383054B1

(12) United States Patent
Rauch

(10) Patent No.: US 6,383,054 B1
(45) Date of Patent: May 7, 2002

(54) ARTICULATED MODEL VEHICLE

(76) Inventor: Russell J. Rauch, 1470 Fishinger Rd., Columbus, OH (US) 43221

( * ) Notice: Subject to any disclaimer, the term of this patent is extended or adjusted under 35 U.S.C. 154(b) by 0 days.

(21) Appl. No.: 09/953,917

(22) Filed: Sep. 17, 2001

(51) Int. Cl.[7] ..... A63H 30/04
(52) U.S. Cl. ..... 446/456; 446/466
(58) Field of Search ..... 446/454, 466, 446/456, 468, 469, 437, 465, 460, 462

(56) References Cited

U.S. PATENT DOCUMENTS 4,696,655 A 9/1987 D'Andrade et al.
5,306,038 A 4/1994 Henderson, Jr.
5,334,077 A 8/1994 Bailey
5,527,059 A 6/1996 Lee, Jr.
5,643,041 A 7/1997 Mukaida
5,722,872 A 3/1998 Simmons et al.
5,762,533 A 6/1998 Tilbor et al.
5,785,576 A 7/1998 Belton
6,036,575 A 3/2000 Rehkemper et al.

*Primary Examiner*—Derris H. Banks
(74) *Attorney, Agent, or Firm*—Thomas S. Baker, Jr.

(57) ABSTRACT

A model vehicle having a normal low-rider configuration is provided with independently repositionable roadway wheels that may be deployed separately and in various combinations, using a manually-switched, battery-powered control, into temporary roadway wheel "hop" positions.

4 Claims, 5 Drawing Sheets

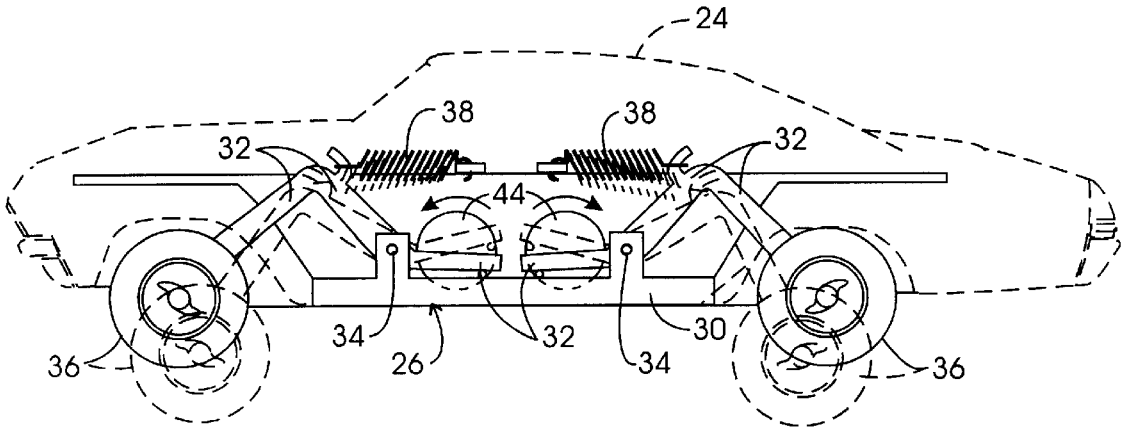
FIG. 7
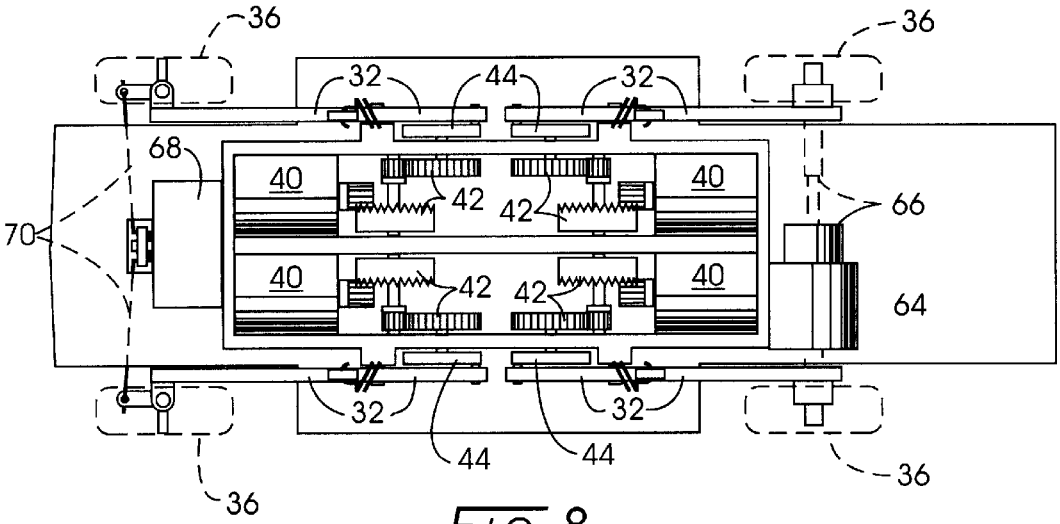
FIG. 8
FIG. 9
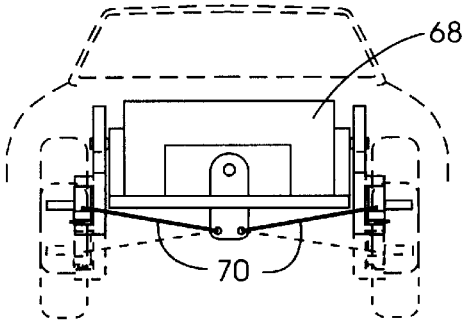

FIG. 10
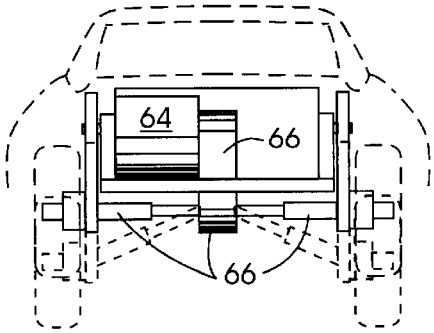
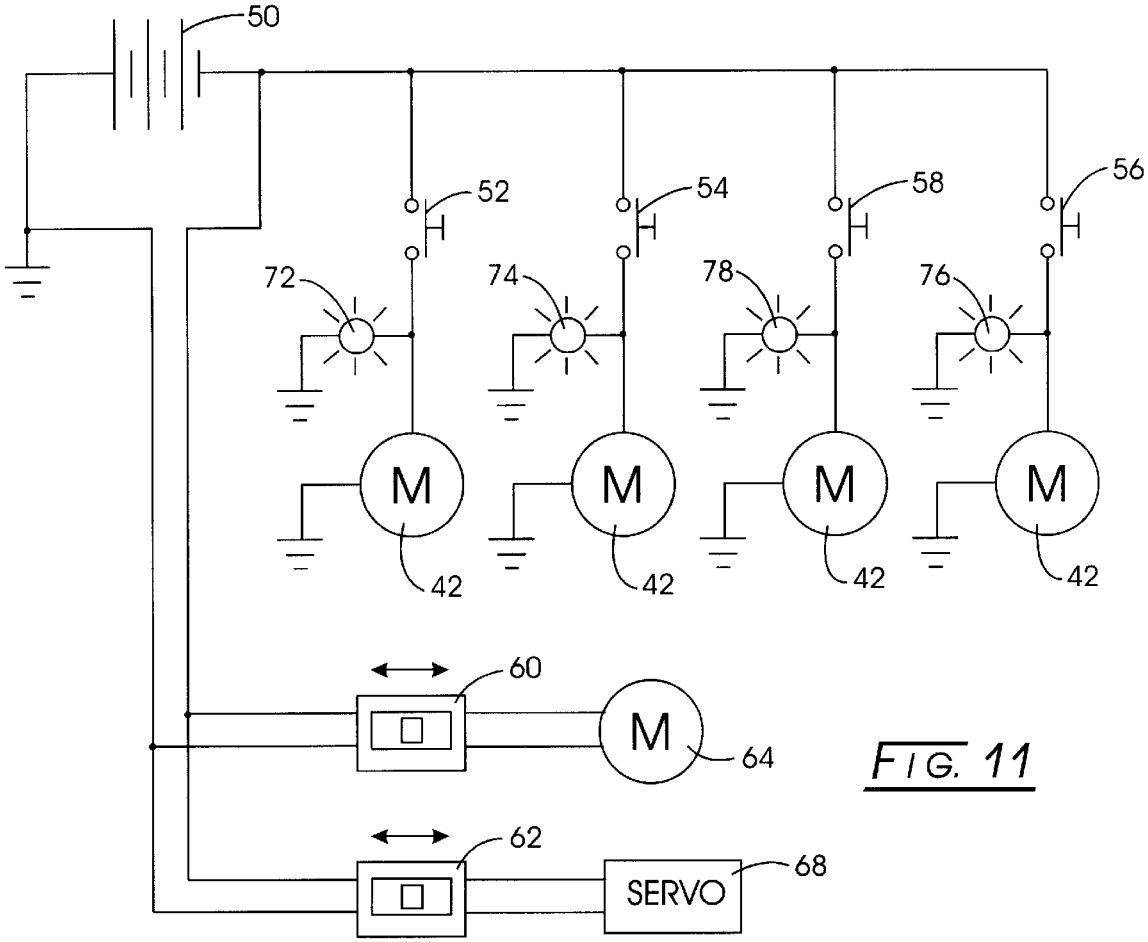
FIG. 11

ARTICULATED MODEL VEHICLE

CROSS-REFERENCES

None.

FIELD OF THE INVENTION

This invention pertains generally to model vehicles intended for juvenile and adult personal amusement or entertainment, and particularly concerns a battery-powered, model automobile that is articulated and that can be easily manually controlled to simulate different low-rider automobile operating configurations.

BACKGROUND OF THE INVENTION

Numerous different model vehicles having hand-held, manually operable controls that control model vehicle speed, model forward/reverse direction, and model steering have been made available in the marketplace in different configurations, including different "low-rider" wheels retracted configurations. Some such available model vehicles have included construction features which, when operated manually, enable the model vehicle to be placed in a limited number of "hop" (wheel actuated/extended) operating configurations such as front-hop, back-hop, see-saw configurations and the like. Because prior model vehicles typically use a single motor to actuate the wheels on each side of the car, only one wheel or both wheels together on each side of the car can be actuated at any one time. Simultaneous, independent actuation of all 4 wheels is not possible.

Accordingly it is a principal purpose and object of the present invention to provide a battery-powered model vehicle that normally has a low-rider operating configuration, and that may be manually controlled to temporarily place and to operate independently and simultaneously each wheel of the model vehicle to achieve various "hop" (wheel actuated/extended) operating configurations, including front-hop, back-hop, see-saw, slammed, 3 wheel extended and all wheel extended configurations. Also, it is an object of the present invention to provide such a battery-powered model vehicle with construction features that enable the vehicle to be promptly restored to its low-rider operating configuration following deployment in a "hop" configuration, and further to provide construction features which enable the model vehicle to be fixed or "posed" in any one of its different "hop" configurations.

Other objects and advantages of the present invention will become apparent during consideration of the descriptions, drawings, and claims which follow.

SUMMARY OF THE INVENTION

A model automobile having a normal low-rider configuration is provided with independently repositionable roadway wheels that may be deployed separately and in various temporary roadway wheel "hop" position combinations, using a manually-switched, battery-powered control.

From a construction standpoint, the invention includes a molded model vehicle chassis, spring biased rocker arms pivotally carried by the model vehicle chassis, a model roadway wheel rotatably carried by each biased and pivoted rocker arm, a chassis-carried, independently-operated, battery-powered drive train for each such rocker arm, and a hand-held control that may be manually operated to independently position each model roadway wheel in a temporary "hop" position as distinguished from a normal low-rider position.

BRIEF DESCRIPTION OF THE DRAWINGS

FIG. 7 is a schematic elevation view of the model vehicle of FIG. 1 illustrating the invention chassis sub-assembly;

FIG. 8 is a schematic plan view of the model vehicle of FIG. 1 also illustrating the invention chassis and drive sub-assemblies;

FIG. 9 is a schematic end elevation view of the model vehicle of FIG. 1 illustrating the invention steering sub-assembly;

FIG. 10 is a schematic end elevation view of the model vehicle of FIG. 1 illustrating the invention drive sub-assembly;

FIG. 11 is a schematic illustration of the invention hand-held, manual control sub-assembly;

Figure 1:
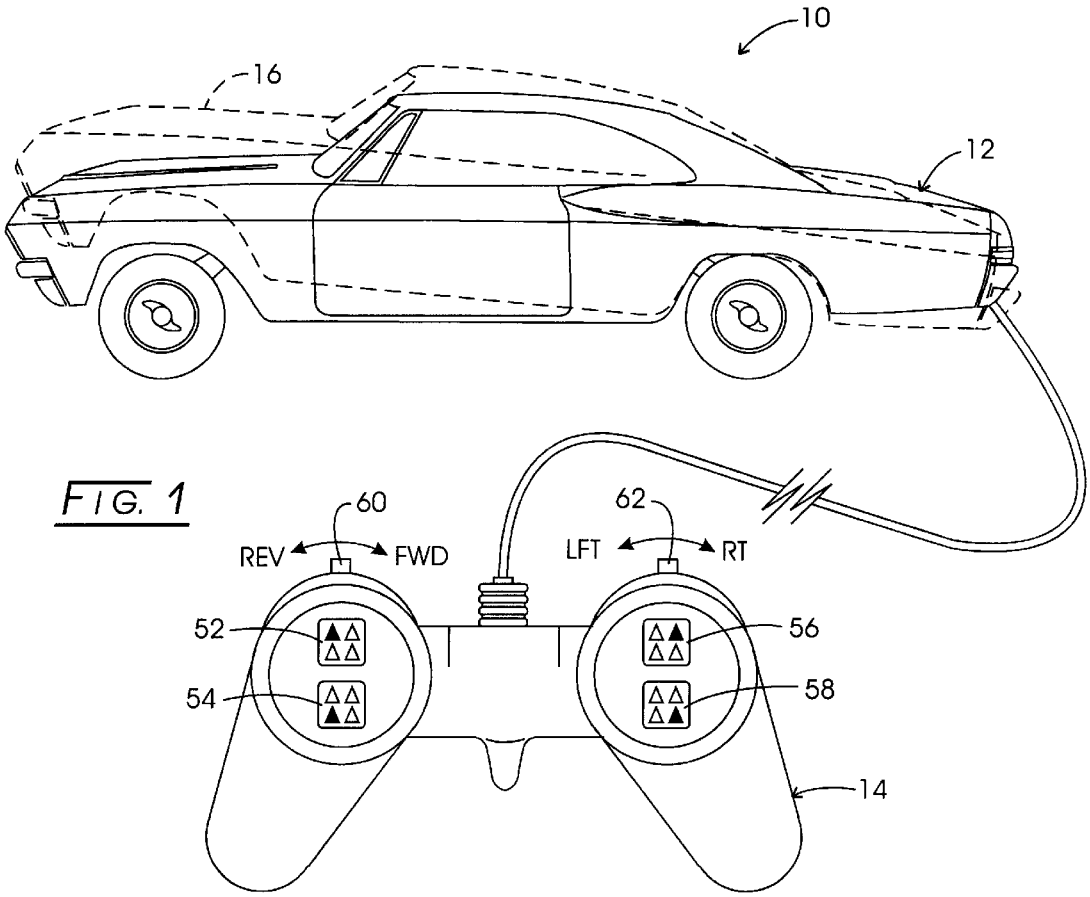
FIG. 1 schematically illustrates a preferred embodiment of the articulated, battery-operated model vehicle of the present invention, and also the hand-held control utilized for its amusement operation.

DETAILED DESCRIPTION:

FIG. 1 schematically illustrates a preferred embodiment 10 of the present invention which basically is comprised of battery-powered model automobile 12 and co-operating hand-held manual control 14. The solid-line illustration of model automobile 12 is of that component in its normal "low-rider" or "slammed" (wheels retracted) configuration condition; the dotted-line illustration of the model automobile in FIG. 1 is of that component with its body in a temporary "front-hop" (front wheels actuated/extended) configuration condition 16.

Figure 2:
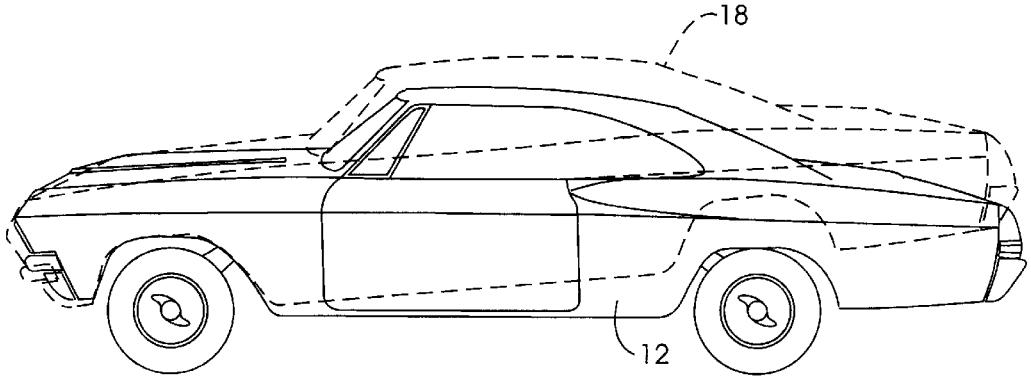
FIGS. 2 through 6 are elevation views of the model vehicle of FIG. 1 illustrating additional temporary operating conditions of the model.
Figure 3:
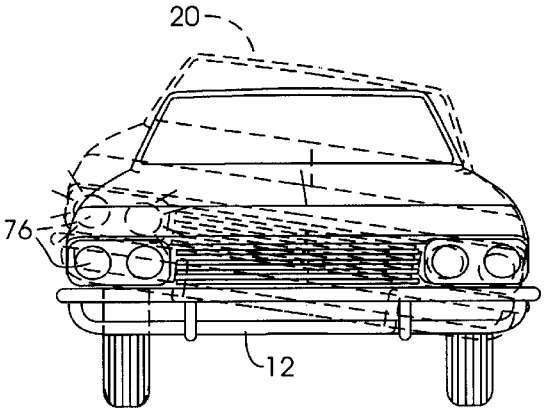
Figure 4:
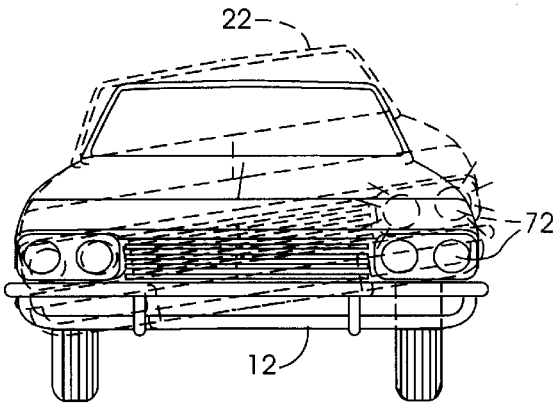
Figure 5:
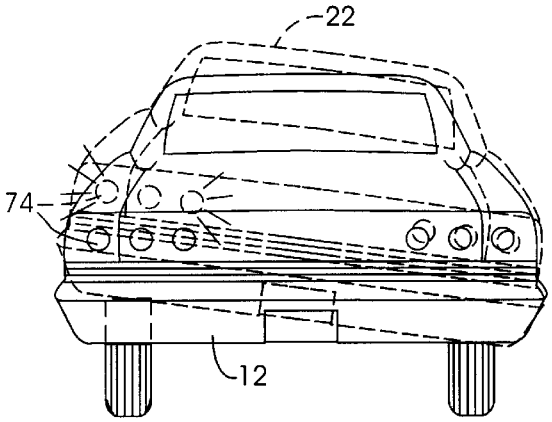
Figure 6:
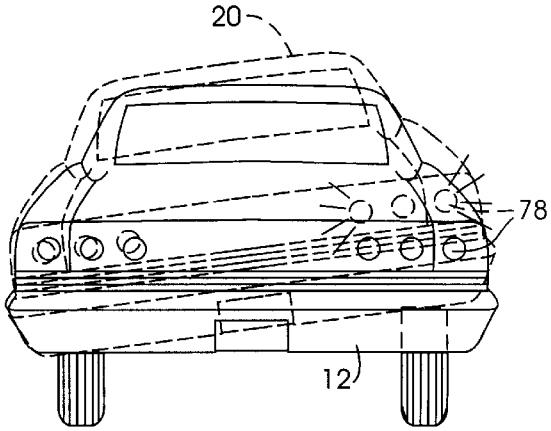

FIGS. 2 through 7 illustrate model automobile 12 in the additional temporary configurations that may be obtained by the operation of control 14. Specifically FIG. 2 schematically illustrates, using dotted-lines, model automobile 12 in a temporary "back-hop" (rear wheels actuated/extended) configuration condition 18. FIGS. 3 and 4, are front elevation views of model automobile 12 illustrated in a dotted-line temporary "right-hop" (2 right side wheels actuated/extended) configuration condition 20 and in a dotted-line temporary "left-hop" (left side wheels actuated/extended) configuration condition 22, respectively. FIGS. 5 and 6 are similar to FIGS. 4 and 3, respectively, except they are model automobile back elevation views. FIG. 7, in addition to illustrating the chassis sub-assembly 26 of model automobile 12, shows the model automobile in a temporary "4 wheel hop" (all wheels actuated/extended) configuration condition 24.

The chassis sub assembly 26 shown in FIGS. 7 and 8 basically is comprised of molded model frame 30, four dog-leg rocker arms 32 that are each pivotally connected at 34 to frame 30, that each carry one of the four model automobile wheels 36, and that are each urged to its normal low-rider condition by a respective coiled tension spring 38. The dotted-line showings in FIG. 7 illustrate those components in their temporarily deployed "hop" (wheels actuated/extended) configuration conditions.

As illustrated in FIG. 8, each rocker arm 32 and wheel 36 combination is driven by a separate battery-powered prime mover 40, which normally has the form of a direct-current rotary solenoid, and an interconnected gear train 42. Four circular drive cranks 44 that are each rotatably driven by the power output gear of a respective gear train 42 independently engage the underside of rocker arms 32 and function to cause separate deployments of model automobile wheels 36 to their "hop" (wheels actuated/extended) configuration condition so long as control 14 is activated to provide energy to a respective prime mover 40. When control 14 is de-activated, tension forces induced in spring elements 38 return the deployed model automobile wheels 36 to their initial or normal "low-rider" (wheels retracted) configuration condition.

Referring again to FIG. 1, hand-held control 14 normally contains several electrical dry-cells, e.g., 4—Size AA alkaline batteries, that constitute the model automobile power supply (see FIG. 11, component 50), and also contains wheel position switches 52, 54, 56, and 58, multi-position forward/reverse motion switch 60, multi-position and steering direction switch 62. Multi-position switch 60 controls reversible motor 64 that in-turn drives the model automobile wheels 36 positioned at the rear of the vehicle through inter-connected drive train and axle 66. (See FIGS. 8 and 10). Multi-position switch 62 controls servo element 68 that in turn steers the automobile wheels 36 positioned at the front of the vehicle through inter-connected connecting rods 70. (See FIGS. 8 and 9).

Although FIG. 1, depicts an electric wire interconnecting hand-held control 14 and model automobile 12, a conventional radio control could be utilized. This would require the batteries or power supply for the drive motors to be mounted in the model automobile 12. Also, a transmitter would have to be incorporated into hand-held control 14 and a receiver would have to be incorporated into automobile 12.

As an added feature, and as shown in FIGS. 3 through 6 and 11, switches 52 through 58 respectively control the battery-powered model vehicle head-lights 72, 76 and tail-lights 74, 78.

Figure 12:
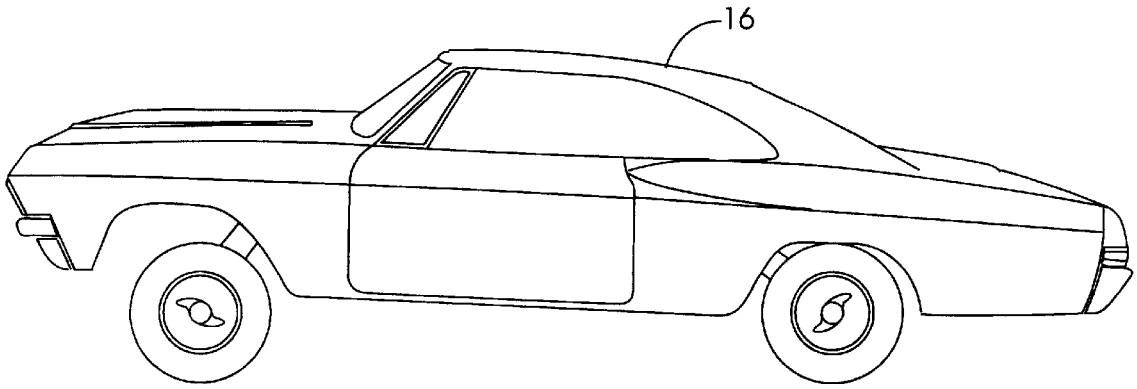
FIG. 12 is a schematic side elevation illustration of the model vehicle of the present invention maintained in a fixed or "posed" condition.
Figure 13:
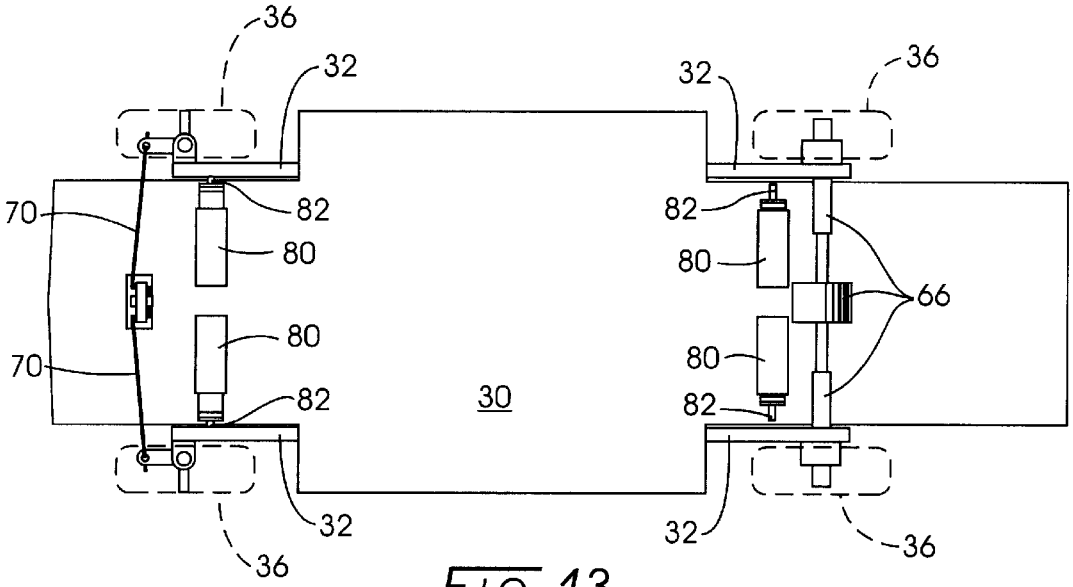
FIG. 13 is a schematic underside plan illustration of the chassis sub-assembly of the model automobile of the present invention as maintained in the "posed" condition of FIG. 12.

FIGS. 12 and 13 pertain to model automobile 12 operated in a "posed" configuration with its front wheels 36 maintained in a fixed rather than temporary "hop" (wheels extended) position. The FIG. 12 illustration specifically relates to a so-called "front hop" (front wheels extended) vehicle configuration condition. Chassis 30 includes four attached housings 80 that each contain an extendible/retractable slide pin 82 which is manually positioned to engage a blind-hole molded in the inner surface of a respective rocker arm 32 when aligned therewith. In FIG. 13 the slide pins 82 provided for selective manual engagement with the rear rocker arms 32 of model automobile 12 are each shown in a retracted position where the slide pins 82 provided for selective manual engagement with the front rocker arms 32 are each shown in an extended position.

Various changes may be made in the size, shape, and inter-relationship of the different invention elements illustrated and described herein without departing from the scope, meaning, or intent of the claims which follow.

I claim as my invention:

1. A model vehicle for personal juvenile or adult amusement and entertainment and normally having a low-rider vehicle configuration, comprising:

a model vehicle chassis;

a model vehicle body removably carried by said model vehicle chassis;

rocker arms pivotally attached to said model vehicle chassis and movable to roadway wheel extension and retraction positions;

model vehicle rotatable roadway wheels carried by said rocker arms;

independently operable roadway wheel drive trains carried by said model vehicle chassis and individually connected to a respective one of said rocker arms; and a hand-held, manually operable, battery-powered control co-operating with and individually controlling said independently operable roadway wheel drive trains, said rocker arms each being spring-biased to a roadway wheel retraction position, and said hand-held, manually operable, battery-powered control being operable to selectively position individual and different combinations of all of said rocker arms in roadway wheel extension positions.

2. The model vehicle invention defined by claim 1, and further comprised of extendible and retractable retention pins carried at the underside of said model vehicle chassis and co-operable retention pin receptacle provided in each said rocker arm, said rocker arm retention pin receptacles each being aligned and engaged with respective extended rocker arm retention pin when said rocker arm is placed non-temporarily in its wheel extension position.

3. The model vehicle invention defined by claim 1, and further comprised of a front set and a rear set of roadway wheels and independently operable and reversible rear wheel drive train carried by said model vehicle chassis and connected to said rear set of roadway wheels; and said hand-held, manually operable, battery-powered control being operable to selectively cause said rear wheel drive train to move said model vehicle forward or in reverse.

4. The model vehicle invention defined by claim 3 further comprised of an independently operable front wheel drive train carried by said model vehicle chassis and connected to said front set of roadway wheels; and said hand-held manually operable, battery-powered control being operable to selectively cause said front wheel drive train to pivot said front wheel set left or right.

* * * * *